US008087271B1

(12) United States Patent
Patton

(10) Patent No.: US 8,087,271 B1
(45) Date of Patent: Jan. 3, 2012

(54) REMOTE KEYLESS SYSTEM

(76) Inventor: Patricia Patton, Osprey, FL (US)

( * ) Notice: Subject to any disclaimer, the term of this patent is extended or adjusted under 35 U.S.C. 154(b) by 924 days.

(21) Appl. No.: 12/148,904

(22) Filed: Apr. 23, 2008

(51) Int. Cl.
*B65D 55/14* (2006.01)

(52) U.S. Cl. ..... 70/63; 70/408; 70/456 R; 206/38.1; 206/305

(58) Field of Classification Search ..... 70/63, 408, 70/454, 455, 456 R; 220/38.1, 305, 320; 206/38.1, 305, 320; D3/207–212
See application file for complete search history.

(56) References Cited

U.S. PATENT DOCUMENTS 3,417,897 A * 12/1968 Johnson ..... 220/254.3
4,420,078 A * 12/1983 Belt et al. ..... 206/305
4,762,227 A * 8/1988 Patterson ..... 206/320
4,881,391 A * 11/1989 Villa et al. ..... 70/455
4,951,817 A * 8/1990 Barletta et al. ..... 206/305
5,388,691 A * 2/1995 White ..... 206/305
5,678,204 A * 10/1997 Naylor ..... 455/90.3
5,755,127 A * 5/1998 Huang ..... 70/456 R
5,850,754 A * 12/1998 Dobbins ..... 70/456 R
5,857,600 A * 1/1999 Akutsu ..... 224/240
5,873,456 A * 2/1999 Hull et al. ..... 206/38.1
6,006,562 A * 12/1999 Wolter ..... 70/456 R
6,155,416 A * 12/2000 Jaime ..... 206/305
6,216,501 B1 4/2001 Marquardt
D456,600 S * 5/2002 Gadson ..... D3/208
6,612,432 B2 * 9/2003 Motson ..... 206/305
6,669,017 B2 * 12/2003 Linihan ..... 206/305
6,786,332 B1 * 9/2004 Patrick et al. ..... 206/305
6,948,614 B1 9/2005 Hall
7,441,651 B1 * 10/2008 Sullivan ..... 206/38.1
7,574,881 B1 * 8/2009 Wong et al. ..... 70/456 R
7,898,387 B2 * 3/2011 Jalil et al. ..... 340/5.64
2005/0208807 A1 9/2005 Lin
2011/0067461 A1 * 3/2011 Hacker ..... 70/63

* cited by examiner

*Primary Examiner* — Suzanne Barrett

(57) ABSTRACT

A lid has a planar front face corresponding to the upper extent of the front surface. The front face terminates in a front free edge. The lid has a rear face corresponding to an upper portion of the upper extent of the rear surface. The rear face terminates in a back free edge. The lid also has a periphery. The periphery includes a top with sides. The periphery terminates at an angled edge. A hinge couples the back free edge of the rear face of the lid and the back surface of the device in proximity to the forward edge. In this manner the lid is adapted to pivot to a closed lower orientation to cover the buttons and an open raised orientation to expose the buttons.

5 Claims, 2 Drawing Sheets

FIG 1
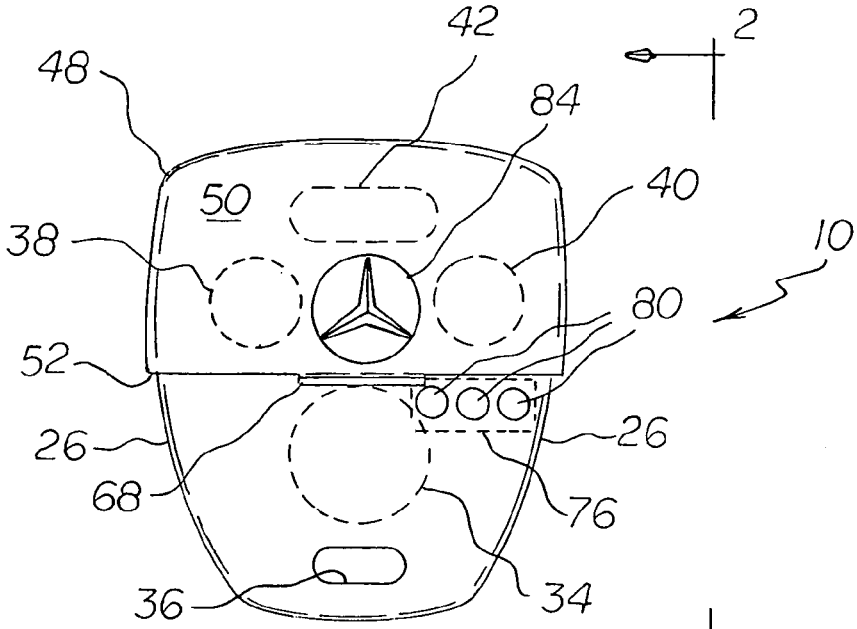
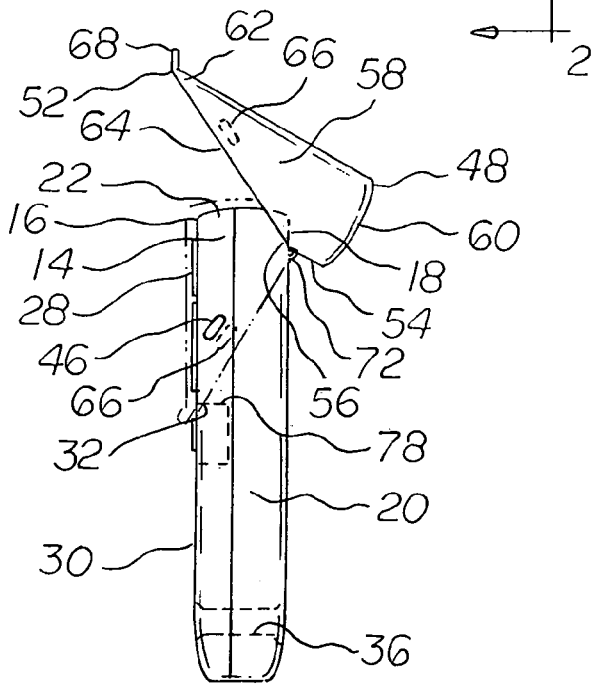
FIG 2

FIG 3
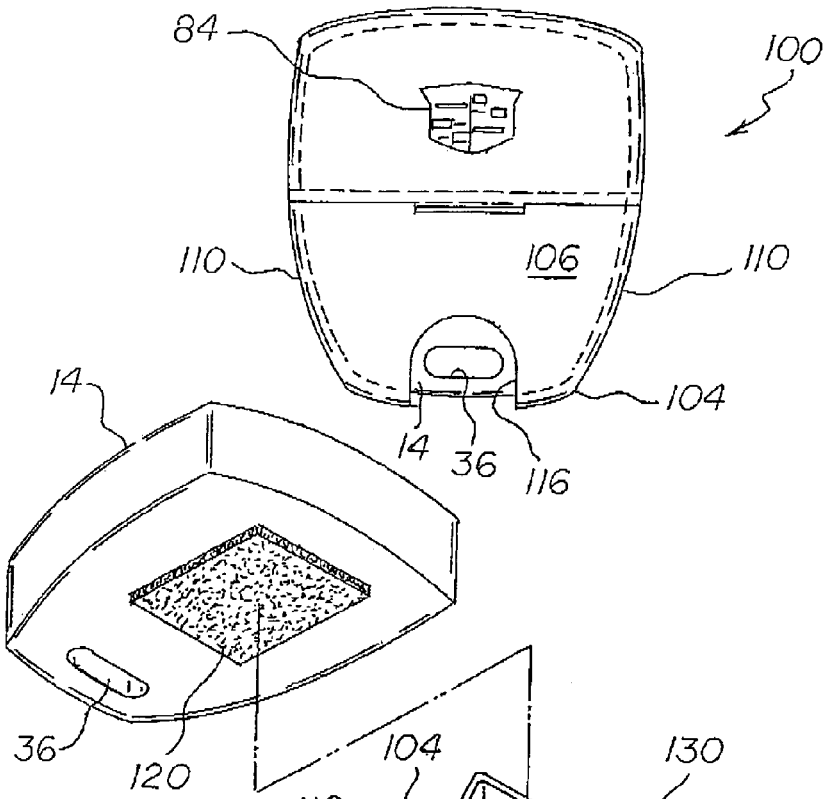
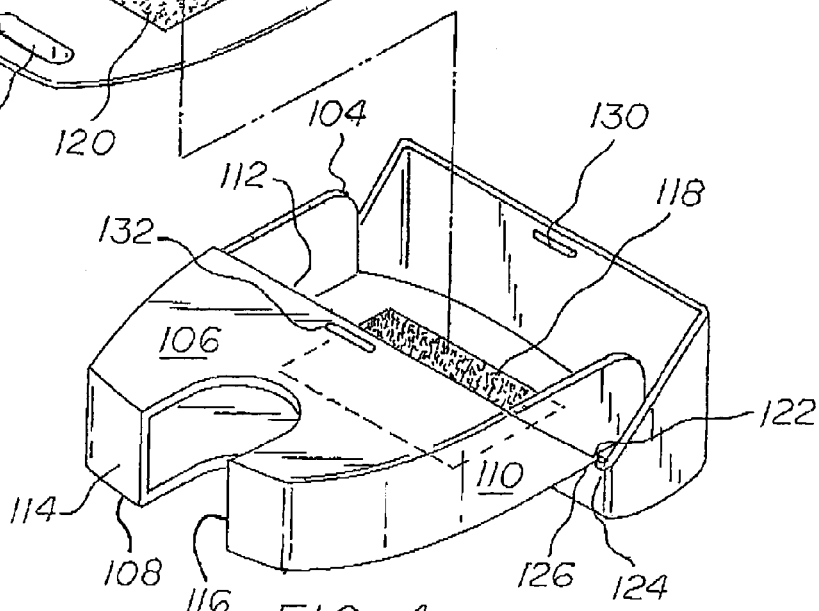
FIG 4

REMOTE KEYLESS SYSTEM

BACKGROUND OF THE INVENTION

1. Field of the Invention

The present invention relates to a remote keyless system and more particularly pertains to selectively covering and uncovering the operating buttons of a remote keyless device to thereby preclude the inadvertent pressing of the covered buttons in a safe, convenient and economical manner.

2. Description of the Prior Art

The use of electronic device protectors of known designs and configurations is known in the prior art. More specifically, electronic device protectors of known designs and configurations previously devised and utilized for the purpose of protecting electronic devices through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 6,216,501 issued Apr. 17, 2001 to Marquardt relates to an Electronic Key. U.S. Pat. No. 6,948,614 issued Sep. 27, 2005 to Hall relates to Automobile Remote Protection. Lastly, U.S. Publication Number 2005/0208807 published Sep. 22, 2005 to Lin relates to a Hinge Structure of a Folder-Type Cell Phone and an Assembling Method Thereof.

While these devices fulfill their respective, particular objectives and requirements, the aforementioned patents do not describe a remote keyless system that allows for selectively covering and uncovering the operating buttons of a remote keyless device to thereby preclude the inadvertent pressing of the covered buttons in a safe, convenient and economical manner.

In this respect, the remote keyless system according to the present invention substantially departs from the conventional concepts and designs of the prior art, and in doing so provides an apparatus primarily developed for the purpose of selectively covering and uncovering the operating buttons of a remote keyless device to thereby preclude the inadvertent pressing of the covered buttons, all in a safe and convenient and economical manner.

Therefore, it can be appreciated that there exists a continuing need for a new and improved remote keyless system which can be used for selectively covering and uncovering the operating buttons of a remote keyless device to thereby preclude the inadvertent pressing of the covered buttons in a safe, convenient and economical manner. In this regard, the present invention including the various embodiments substantially fulfills this need.

SUMMARY OF THE INVENTION

In view of the foregoing disadvantages inherent in the known types of electronic device protectors of known designs and configurations now present in the prior art, the present invention provides an improved remote keyless system. As such, the general purpose of the present invention, which will be described subsequently in greater detail, is to provide a new and improved remote keyless system and method which has all the advantages of the prior art and none of the disadvantages.

To attain this, the present invention essentially comprises a remote keyless system. First provided is a remote keyless device. The device has a front surface. The device has a similarly configured back surface. The device has a periphery.

The periphery extends around the front and back surfaces. The periphery includes a forward edge. The periphery includes a rearward edge. The periphery includes spaced lateral edges. The spaced lateral edges are provided between the forward and rearward edges. The device has an upper extent. The device has a lower extent. The device has a dividing line. The dividing line is provided between the upper and lower extents. The dividing line is essentially equally spaced from the forward and rearward edges, plus or minus 10 percent. The device has battery. The battery is provided within the lower extent of the device. The device has a slot. The slot extends through the lower extent adjacent to the rearward edge. The slot is adapted to receive a key ring and the like.

The device has a plurality of buttons. The buttons include a lock button. The lock button is adapted to lock a door of an associated vehicle when pressed. The buttons include an unlock button. The unlock button is adapted to unlock a door of an associated vehicle when pressed. The panic button is adapted to emit a warning sound from an associated vehicle when pressed. The buttons are positioned on upper extent of the front surface of the remote keyless device. At least one of the side edges has a fixed projection. The fixed projection is provided in the upper extent closer to the front surface than the back surface.

A lid is provided. The lid has a planar front face. The front face is in a generally rectangular configuration corresponding to the upper extent of the front surface of the device. The front face extends downwardly. The front face terminates in a front free edge. The lid has a planar rear face. The rear face is in a generally rectangular configuration corresponding to an upper portion of the upper extent of the rear surface of the device. The rear face extends downwardly. The rear face terminates in a back free edge. The front face has a surface area. The surface area of the front face is between 5 and 6 times greater than the surface area of the rear face. The lid also has a periphery. The periphery of the lid couples the front and rear faces. The periphery including a top. The periphery includes sides. The sides terminate at an angled edge. The angled edge forms an angle of about 30 degrees with respect to the front face.

At least one of the sides of the periphery of the lid has a movable projection. The movable projection is provided in interference relationship with the fixed projections. In this manner retention of the lid in position when covering the buttons is facilitated. The lid also has a lip. The lip extends outwardly from the front free edge. In this manner contact by a user in moving the lid when opening and closing the system is provided.

Provided next is a self hinge. The self hinge is fabricated of a rigid plastic. The self hinge has a thinner cross section. The thinner cross section is provided at the line of flexure. The self hinge couples the back free edge of the rear face of the lid and the back surface of the device in proximity to the forward edge. The hinge is preferably a self hinge. The hinge has an upper part. The upper part is integrally formed with the back free edge of the lid. The hinge has a lower part. The lower part is integrally formed with a device. The material for the self hinge is, preferably, an essentially rigid plastic material.

The lid is adapted to pivot to a closed lower orientation. Note FIG. 1. In the closed lower orientation the front free edge of the lid is located in contact with the front surface of the device adjacent to the dividing line. The top of the periphery of the lid is in contact with the forward edge of the device. The lid is out of contact with the buttons. Further the lid is adapted to pivot to an open raised orientation. Note FIG. 2. In the open raised orientation the front free edge of the lid is located above the device. The top of the periphery of the lid is laterally offset from the forward edge of the device.

Further provided is an electronic lock. The electronic lock is provided in the device adjacent to the dividing line of the device. The electronic lock has securement elements. The securement elements selectively secure and release the device and the lid. The electronic lock also includes a plurality of push-buttons. In this manner the securement elements are shifted between secure and release orientations.

Provided last are indicia. The indicia are provided on the front face of the lid. The indicia are in a design of an associated vehicle. The indicia are of a rigid metallic material. In this manner the rigidity of the front face is increased. Further in this manner the inadvertent pressing of the buttons is precluded.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved remote keyless system which has all of the advantages of the prior art electronic device protectors of known designs and configurations and none of the disadvantages.

It is another object of the present invention to provide a new and improved remote keyless system which may be easily and efficiently manufactured and marketed.

It is further object of the present invention to provide a new and improved remote keyless system which is of durable and reliable constructions.

An even further object of the present invention is to provide a new and improved remote keyless system which is susceptible of a low cost of manufacture with regard to both materials and labor, and which accordingly is then susceptible of low prices of sale to the consuming public, thereby making such remote keyless system economically available to the buying public.

Even still another object of the present invention is to provide a remote keyless system for selectively covering and uncovering the operating buttons of a remote keyless device to thereby preclude the inadvertent pressing of the covered buttons in a safe, convenient and economical manner.

Lastly, it is an object of the present invention to provide a new and improved remote keyless system. A lid has a planar front face corresponding to the upper extent of the front surface. The front face terminates in a front free edge. The lid has a rear face corresponding to an upper portion of the upper extent of the rear surface. The rear face terminates in a back free edge. The lid also has a periphery. The periphery includes a top with sides. The periphery terminates at an angled edge. A hinge couples the back free edge of the rear face of the lid and the back surface of the device in proximity to the forward edge. In this manner the lid is adapted to pivot to a closed lower orientation to cover the buttons and an open raised orientation to expose the buttons.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a remote keyless system constructed in accordance with the principles of the present invention.

FIG. 2 is a side elevational view taken along line 2-2 of FIG. 1 but with the lid in a raised orientation.

FIG. 3 is a front elevational view of a remote keyless system constructed in accordance with an alternate embodiment of the invention.

FIG. 4 is an exploded perspective view of the embodiment shown in FIG. 3.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved remote keyless system embodying the principles and concepts of the present invention and generally designated by the reference numeral 10 will be described.

The present invention, the remote keyless system 10 is comprised of a plurality of components. Such components in their broadest context include a lid and a hinge. Such components are individually configured and correlated with respect to each other so as to attain the desired objective.

First provided is a remote keyless device 14. The device has a front surface 16. The device has a similarly configured back surface 18. The device has a periphery 20. The periphery extends around the front and back surfaces. The periphery includes a forward edge 22. The periphery includes a rearward edge 24. The periphery includes spaced lateral edges 26. The spaced lateral edges are provided between the forward and rearward edges. The device has an upper extent 28. The device has a lower extent 30. The device has a dividing line 32. The dividing line is provided between the upper and lower extents. The dividing line is essentially equally spaced from the forward and rearward edges, plus or minus 10 percent. The device has battery 34. The battery, is provided within the lower extent of the device. The device has a slot 36. The slot extends through the lower extent adjacent to The rearward edge. The slot is adapted to receive a key ring and the like.

The device has a plurality of buttons. The buttons include a lock button 38. The lock button is adapted to lock a door of an associated vehicle when pressed. The buttons include an unlock button 40. The unlock button is adapted to unlock a door of an associated vehicle when pressed. The panic button 42 is adapted to emit a warning sound from an associated vehicle when pressed. The buttons are positioned on upper extent of the front surface of the remote keyless device. At least one of the side edges has a fixed projection 46. The fixed projection is provided in the upper extent closer to the front surface than the back surface.

A lid 48 is provided. The lid has a planar front face 50. The front face is in a generally rectangular configuration corresponding to the upper extent of the front surface of the device. The front face extends downwardly. The front face terminates in a front free edge 52. The lid has a planar rear face 54. The rear face is in a generally rectangular configuration corresponding to an upper portion of the upper extent of the rear surface of the device. The rear face extends downwardly. The rear face terminates in a back free edge 56. The front face has a surface area. The surface area of the front face is between 5 and 6 times greater than the surface area of the rear face. The lid also has a periphery 58. The periphery of the lid couples the front and rear faces. The periphery including a top 60. The periphery includes sides 62. The sides terminate at an angled edge 64. The angled edge forms an angle of about 30 degrees with respect to the front face.

At least one of the sides of the periphery of the lid has a movable projection 66. The movable projection is provided in interference relationship with the fixed projections. In this manner retention of the lid in position when covering the buttons is facilitated. The lid also has a lip 68. The lip extends outwardly from the front free edge. In this manner contact by a user in moving the lid when opening and closing the system is provided.

Provided next is a self hinge 72. The self hinge is fabricated of a rigid plastic. The self hinge has a thinner cross section. The thinner cross section is provided at the line of flexure. The self hinge couples the back free edge of the rear face of the lid and the back surface of the device in proximity to the forward edge. The hinge is preferably a self hinge. The hinge has an upper part. The upper part is integrally formed with the back free edge of the lid. The hinge has a lower part. The lower part is integrally formed with a device. The material for the self hinge is, preferably, an essentially rigid plastic material.

The lid is adapted to pivot to a closed lower orientation. Note FIG. 1. In the closed lower orientation the front free edge of the lid is located in contact with the front surface of the device adjacent to the dividing line. The top of the periphery of the lid is in contact with the forward edge of the device. The lid is out of contact with the buttons. Further the lid is adapted to pivot to an open raised orientation. Note FIG. 2. In the open raised orientation the front free edge of the lid is located above the device. The top of the periphery of the lid is laterally offset from the forward edge of the device.

Further provided is an electronic lock 76. The electronic lock is provided in the device adjacent to the dividing line of the device. The electronic lock has securement elements 78. The securement elements selectively secure and release the device and the lid. The electronic lock also includes a plurality of push-buttons 80. In this manner the securement elements are shifted between secure and release orientations.

Provided last are indicia 84. The indicia are provided on the front face of the lid. The indicia are in a design of an associated vehicle. The indicia are of a rigid metallic material. In this manner the rigidity of the front face is increased. Further in this manner the inadvertent pressing of the buttons is precluded.

Reference is now made to the alternate embodiment illustrated in FIGS. 3 and 4. The system also includes a housing 104. The housing is adapted to removably receive the lower extent of a remote keyless device. The housing has a top face 106. The housing has a bottom face 108. The housing has side faces 110. The side faces are provided between the top and bottom faces. In this manner an open top 112 and a bottom 114 are formed. The housing has a notch 116. The notch exposes a slot in the device.

The system also includes a fixed pile type fastener 118. The fixed pile type fastener is attached to the bottom face. The fixed pile type fastener faces the top face. The system also includes a co-operable pile type fastener. The co-operable pile type fastener is attached to the back surface of the device. In this manner the device is removably coupled in the housing. A hinge 122 is provided. The hinge is a self hinge. The hinge has an upper part 124. The upper part is integrally formed with the back free edge of the lid. The hinge has a lower part 126. The lower part is integrally formed with the bottom face. Lastly, the system includes a fixed projection 132 on the front face of the housing adjacent to the upper extent and a movable projection 130 on the front face of the lid in interference relationship with the fixed projection to facilitate the retention of the lid in position when covering the buttons. The various components of the alternate embodiment are essentially the same as in the primary embodiment unless otherwise specified.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A remote system for use with a remote device of the type having front and back surfaces with a periphery including forward and rearward edges and with spaced lateral edges, the device also having upper and lower extents with a dividing line, a plurality of buttons positioned on the upper extent of the front surface;

a lid having a planar front face corresponding to the upper extent of the front surface terminating in a front free edge, the lid having a rear face corresponding to an upper portion of the upper extent of the rear surface and terminating in a back free edge, the lid also having a periphery including a top with sides terminating at an angled edge; and a hinge coupling the back free edge of the rear face of the lid and the back surface of the device in proximity to the forward edge whereby the lid is adapted to pivot to a closed lower orientation to cover the buttons and an open raised orientation to expose the buttons.

2. The system as set forth in claim 1 wherein the hinge is a self hinge fabricated of a rigid plastic with a thinner cross section at the line of flexure with an upper part integrally formed with the back free edge of the lid and a lower part integrally formed with a device.

3. The system as set forth in claim 1 and further including:

a fixed projection adjacent to the upper extent and a movable projection in interference relationship with the fixed projection to facilitate the retention of the lid in position when covering the buttons.

4. The system as set forth in claim 1 and further including:

indicia on the front face of the lid in a design of an associated vehicle, the indicia being of a rigid metallic material to increase the rigidity of the front face to further preclude inadvertent pressing of the buttons.

5. A remote keyless system for selectively covering and uncovering the operating buttons of a remote keyless device to thereby preclude the inadvertent pressing of the covered buttons a safe, convenient and economical manner comprising, in combination:

a remote keyless device having a front surface and a similarly configured back surface with a periphery extending around the front and back surfaces, the periphery including a forward edge and a rearward edge with spaced lateral edges between the forward and rearward edges, the device having an upper extent and a lower extent with a dividing line between the upper and lower extents essentially equally spaced from the forward and rearward edges, plus or minus 10 percent, a battery within the lower extent of the device, a slot extending through the lower extent adjacent to the rearward edge adapted to receive a key ring and the like, a plurality of buttons including a lock button adapted when pressed to lock a door of an associated vehicle and an unlock button adapted when pressed to unlock a door of an associated vehicle and a panic button adapted when pressed to emit a warning sound from an associated vehicle, the buttons being positioned on upper extent of the front surface of the remote keyless device, at least one of the side edges having a fixed projection in the upper extent closer to the front surface than the back surface;

a lid having a planar front face in a generally rectangular configuration corresponding to the upper extent of the front surface of the device extending downwardly and terminating in a front free edge, the lid having a planar rear face in a generally rectangular configuration corresponding to an upper portion of the upper extent of the rear surface of the device extending downwardly and terminating in a back free edge, the front face having a surface area between 5 and 6 times greater than the surface area of the rear face, the lid also having a periphery coupling the front and rear faces and including a top and sides terminating at an angled edge, the angled edge forming an angle of about 30 degrees with respect to the front face, at least one of the sides of the periphery of the lid having a movable projection in interference relationship with the fixed projection to facilitate the retention of the lid in position when covering the buttons, the lid also having a lip extending outwardly from the front free edge for contact by a user in moving the lid when opening and closing the system;

a self hinge fabricated of a rigid plastic with a thinner cross section at the line of flexure coupling the back free edge of the rear face of the lid and the back surface of the device in proximity to the forward edge whereby the lid is adapted to pivot to a closed lower orientation with the front free edge of the lid located in contact with the front surface of the device adjacent to the dividing line and with the top of the periphery of the lid in contact with the forward edge of the device and with the lid out of contact with the buttons, and whereby the lid is adapted to pivot to an open raised orientation with the front free edge of the lid located above the device and with the top of the periphery of the lid laterally offset from the forward edge of the device;

an electronic lock in the device adjacent to the dividing line of the device with securement elements to selectively secure and release the device and the lid, the electronic lock also including a plurality of push-buttons for shifting the securement elements between secure and release orientations; and indicia or the front face of the lid in a design of an associated vehicle, the indicia being of a rigid metallic material to increase the rigidity of the front face to further preclude inadvertent pressing of the buttons.

* * * * *